United States Patent [19]

Sawyer

[11] Patent Number: 4,971,505

[45] **Date of Patent: * Nov. 20, 1990**

[54] ARCHITECTURAL STRUCTURE FOR OCCUPANCY AND PARKING

[76] Inventor: Frank Sawyer, 209 Columbus Ave., Boston, Mass. 02116

[ * ] Notice: The portion of the term of this patent subsequent to Oct. 18, 2005 has been disclaimed.

[21] Appl. No.: 257,332

[22] Filed: Oct. 13, 1988

Related U.S. Application Data

[62] Division of Ser. No. 911,530, Sep. 25, 1986, Pat. No. 4,778,324.

[51] Int. Cl.[5] ..... E04H 6/06

[52] U.S. Cl. ..... 414/232; 414/21; 414/261; 414/273; 187/16; 52/175

[58] Field of Search ..... 414/231, 232, 233, 234, 414/247, 249, 252, 21, 242, 261, 273; 52/30, 175, 185; 187/16

[56] References Cited

U.S. PATENT DOCUMENTS

| | | | |
|---|---|---|---|
| 1,303,978 | 5/1919 | Smith . | |
| 1,394,999 | 10/1921 | McKinstry . | |
| 1,432,132 | 10/1922 | Sturges | 52/175 |
| 1,539,761 | 5/1925 | Murray . | |
| 1,781,753 | 11/1930 | Flannery . | |
| 2,455,507 | 12/1948 | Light . | |
| 2,687,815 | 8/1954 | Simon . | |
| 2,796,952 | 6/1957 | Brumby . | |
| 2,799,406 | 7/1957 | Alimanestiano . | |
| 3,290,837 | 12/1966 | Weston | 52/30 |
| 3,323,617 | 6/1967 | Inuzuka et al. | 414/251 X |
| 3,944,085 | 3/1976 | Obregon . | |
| 4,322,804 | 3/1982 | Evans | 414/231 X |

FOREIGN PATENT DOCUMENTS

| | | | |
|---|---|---|---|
| 1397778 | 3/1965 | France | 414/249 |

OTHER PUBLICATIONS

Dover Corporation/Elevator Division, "Dover Elevator Lifts" (seven pages of advertising materials).

*Primary Examiner*—Frank E. Werner

*Attorney, Agent, or Firm*—Morse, Altman, Dacey & Benson

[57] ABSTRACT

The present invention is to provide, for use on a limited site, an integrated architectural structure comprising particular personal occupancy space, particular automotive vehicle parking space, and particular access space communicating therebetween, all intimately juxtaposed. The personal occupancy space contains a plurality of personal occupancy units, i.e. apartments or offices, and at least one personal occupancy elevator and stairwell. The vehicle parking space contains one or more elevator lifts of specific design, namely, a lift that is movable only vertically and that includes a vertical array of levels, each level of which includes a horizontal array of automotive vehicle locations. Movement of this parking lift to selected vertical positions is such that selected levels of the vertical array communicate with the access level at selected times for vehicle storage or vehicle retrieval. Preferably, the parking lift is responsive to coded computer circuitry that reduces the driver's involvement with the parking mechanisms to a minimum.

7 Claims, 11 Drawing Sheets

ARCHITECTURAL STRUCTURE FOR OCCUPANCY AND PARKING

This is a division of application Ser. No. 911,530, filed on Sept. 25, 1986, issued as U.S. Pat. No. 4,778,324, Oct. 18, 1988.

BACKGROUND OF THE INVENTION

1. Field Of The Invention

The present invention relates to architectural structures and, more particularly, to architectural buildings, usually urban buildings, that are designed for both personal occupancy and automotive parking.

2. The Prior Art

Urban buildings increasingly suffer from insufficient adjacent or integrated parking facilities. Such parking facilities in recent years have taken various typical forms.

One type of conventional parking facility is an elevator garage in which an attendant drives a vehicle to be stored from an access level onto a single lift elevator, transports the vehicle along vertical columns and horizontal rows to an upper storage location, drives the vehicle from the lift to the storage location, and then returns to the access level. Retrieval requires these steps in reverse. Such elevator garages are costly to maintain because of the required number of elevator attendants and complexity of the equipment.

In another type of parking facility, parking is achieved by the driver himself, negotiating up or down ramps, and corridors until a level with an empty parking location is found, after which the driver leaves that level by stairway or elevator. Retrieval requires these steps in reverse. Such a drive-and-park garage requires a relatively large site to provide adequate room for the up and down ramps and corridors.

Many prior art elevator garages and drive-and-park garages suffer from the disadvantage that vehicles being parked must be kept running until finally stored, and vehicles that have been stored must be kept running while being retrieved. One prior art elevator system that does not suffer from this problem comprises vertically (not horizontally) movable elevators, each of which has a vertical array of levels, any given level communicating with an access level depending on the vertical location of the elevator. As will be explained below, this type of elevator has been found to have characteristics that lend themselves, when specifically designed, to the architectural structure of the present invention.

SUMMARY OF THE INVENTION

The object of the present invention is to provide, for use on a limited site, an integrated architectural structure comprising particular personal occupancy space, particular automotive vehicle parking space, and particular access space communicating therebetween, all intimately juxtaposed. The personal occupancy space contains a plurality of personal occupancy units, i.e. apartments or offices, and at least one personal occupancy elevator and stairwell. The vehicle parking space contains one or more elevator lifts of specific design, namely, a lift that is movable only vertically and that includes a vertical array of levels, each level of which includes a horizontal array of automotive vehicle locations. Movement of this parking lift to selected vertical positions is such that selected levels of the vertical array communicate with the access level at selected times for vehicle storage or vehicle retrieval. The preferred configuration is such that the parking space has a relatively low rise and the occupancy space extends over the parking space and has a relatively high rise. Preferably, the parking lift is responsive to a computer that includes memory circuitry having coded designations of parking locations and coded indices of whether they are empty or full, input terminal circuitry at the access area for receiving coded identifications of vehicle drivers, logic circuitry for generating associations and dissociations of the coded designations and the coded identifications to provide coded empty and full indices, and a control system for causing the movement of the parking lift to a selected vertical position when a selected coded designation is specified by a selected coded identification as permitted by a selected coded index.

The system is such that an incoming driver actuates an terminal while seated in his car by punching his code into a key pad or inserting a coded plastic card into a reader slot. The computer system matches the driver's code with an empty location and directs the elevator to move vertically until the empty location is available to the access region. The driver drives the vehicle into the available location, locks his car, and returns to the access area. The driver then actuates an input terminal to notify the computer system that the lift is available for further storage and retrieval. The driver then is free to leave, never having been required to enter the parking space other than at the access level. When retrieving his car, the driver merely reverses the above steps. The driver is in the elevator only when he stores or retrieves his car at access level. The vehicle engine is off at all other times.

Other objects of the present invention will in part be obvious and will in part appear hereinafter.

BRIEF DESCRIPTION OF THE DRAWINGS

For a fuller understanding of the nature and objects of the present invention, reference is made to the following detailed disclosure, which is to be taken in connection with the accompanying drawings wherein.

DESCRIPTION OF THE PREFERRED EMBODIMENT

Figure 1:
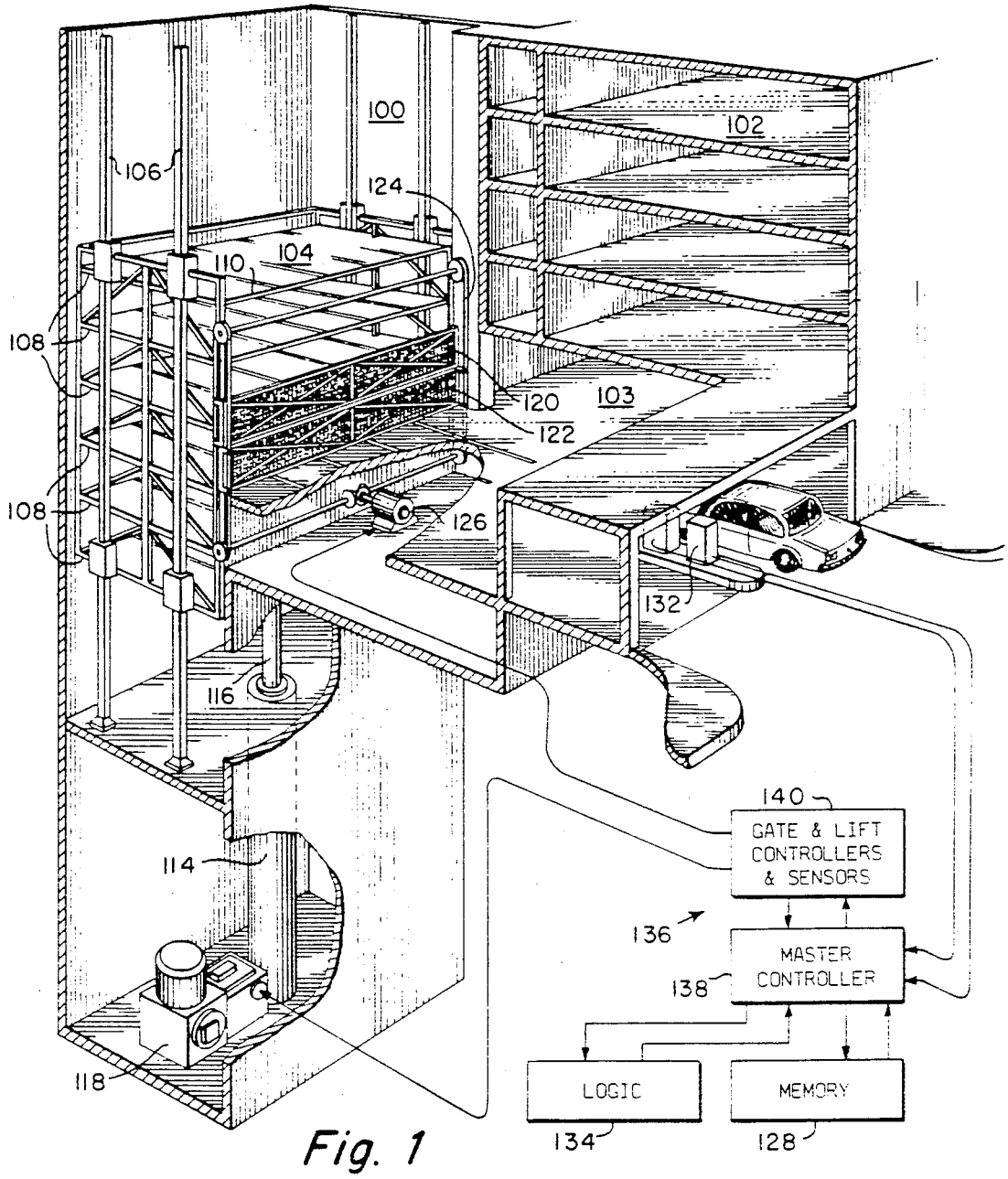
FIG. 1 is a schematic, partly in broken-away mechanical perspective and partly in electrical block of the parking lift and computer system of the present invention.
Figure 2:
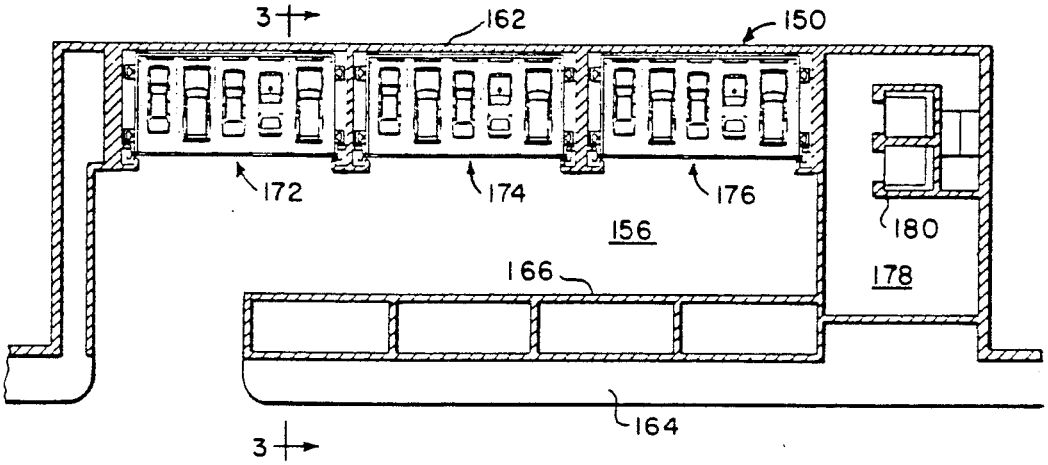
FIG. 2 is a broken away, top plan view at ground level of an architectural structure embodying the present invention.
Figure 3:
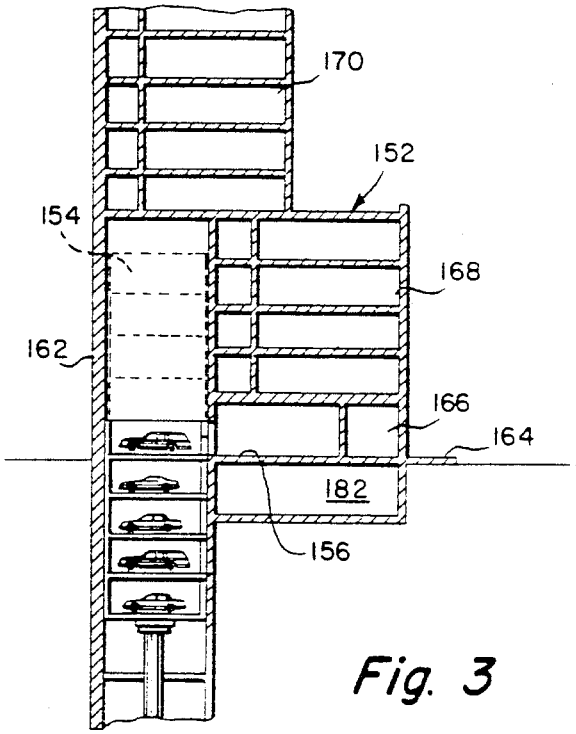
FIG. 3 is a cross section of the architectural structure of FIG. 2, taken along the lines 3—3.

FIG. 1 shows a parking lift and computer system of the type incorporated into an architectural structure occupying a limited site in accordance with the present invention. The system is shown as comprising automotive vehicle parking space 100, personal occupancy space 102 and access space 103, which communicates between the parking space and personal occupancy space. The vehicle parking space and the personal occupancy space are intimately juxtaposed as will be explained in connection with FIGS. 2–16.

Figure 6:
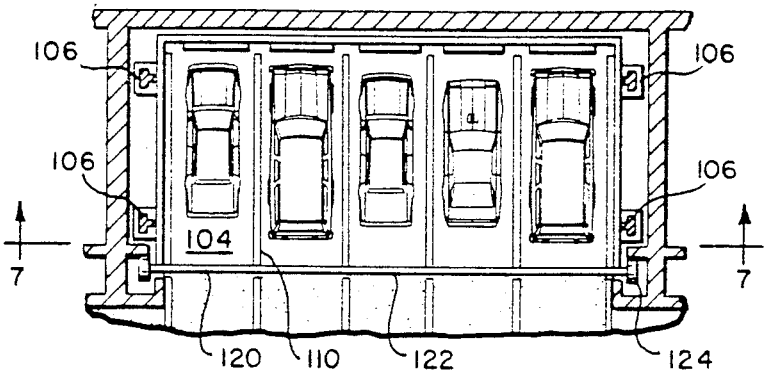
FIG. 6 is a broken-away plan view of the lift of FIG. 1.
Figure 7:
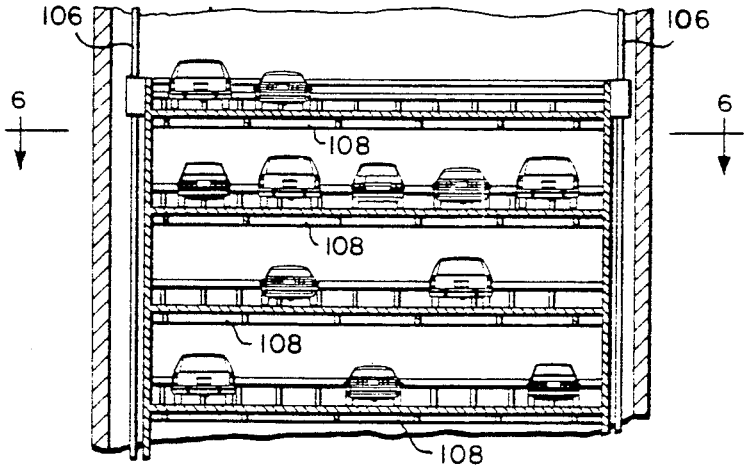
FIG. 7 is a broken away sectional view of the lift of FIG. 6, the section being taken along the lines 7—7 of FIG. 6.
Figure 8:
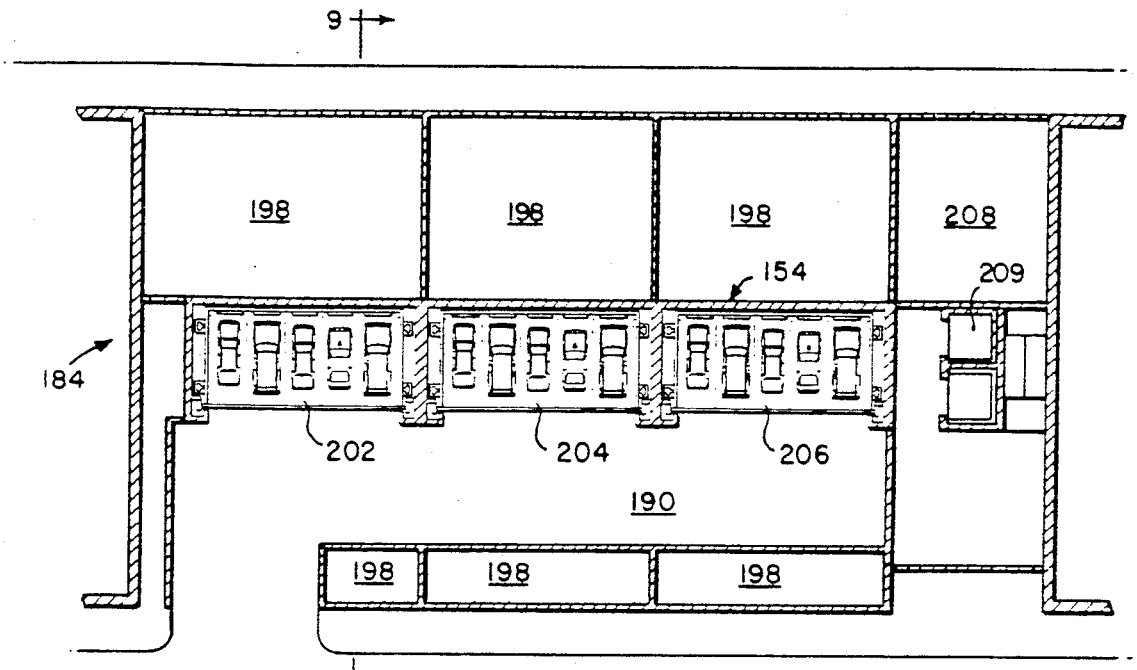
FIG. 8 is a broken-away, top plan view at ground level of another architectural structure embodying the present invention.
Figure 9:
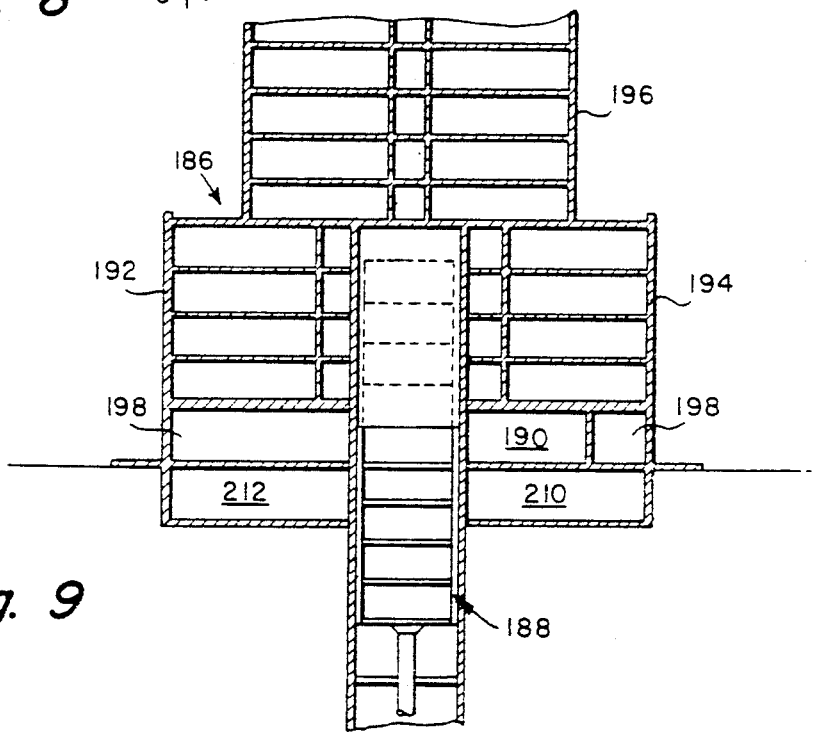
FIG. 9 is a cross section of the architectural structure of FIG. 8, taken along the lines 9—9.

With reference to FIGS. 6 and 7, as well as to FIG. 1, a parking lift 104 in the automotive vehicle parking space is movable only vertically along vertical tracks 106 and includes a vertical array of five levels 108, each level including a horizontal array of automobile vehicle parking locations separated by lines 110. The lift is moved and supported from below by a hydraulic cylinder 114 and a hydraulic piston 116. The height of piston 116 above cylinder 114 is controlled by a hydraulic oil reservoir 118 and not by the building structure. This construction permits relatively inexpensive elevator well walls and avoids the requirement of a penthouse. This unit is selected for its omission of cables, gears and sheaves that might tend to malfunction. Pump valves and cylinders operate in oil at all times so that wear is negligible. Such a lift has a capacity of 100,000 pounds or more and operates at speeds up to 200 feet per minute As a practical matter, the length of the piston is limited to approximately 70 feet or seven stories. The ingress/egress of lift 104 at an access level 103 is provided with vertical bi-parting steel hatchway doors 120, 122 that are counterbalanced and automatically operable by a pulley system 124 and motor 126 through suitable gearing. These doors are interlocked to prevent operation of the lift unless they are closed and locked.

The control system includes memory circuitry 128 having coded designations of the parking spaces and coded indices of whether they are empty or full, input circuitry including a coded plastic card reader 132 at the access area for receiving coded identifications of automotive vehicle drivers, logic circuitry 134 for generating associations and disassociations of the coded designations and the coded identifications to provide coded indications of empty and full, and control circuitry 136. Control circuitry 136 includes a master controller 138 that is responsive to coded signals from terminal 132, and gate and lift controllers and sensors 140. These controllers and sensors cause the motive system to move the parking lift to a selected vertical position with one of its levels at access level 103 when a selected coded designation is specified by a selected coded identification as permitted by a selected coded index, and to open and close doors 120, 122 at appropriate times. In various forms, the input means comprises a coded plastic card reader at the entrance to the access area, or a weight sensor or photoelectric sensor to indicate that a particular location is empty or full.

THE EMBODIMENT OF FIGS. 2–7

Figure 4:
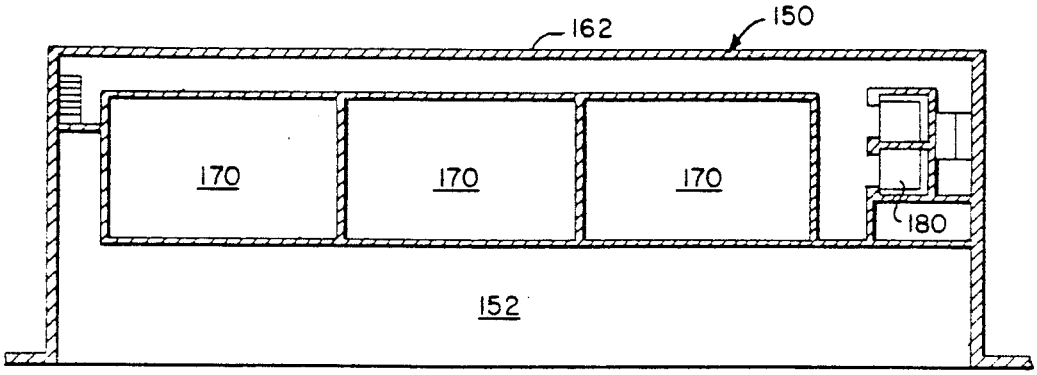
FIG. 4 is a broken away, top plan view at one of levels 2 through 5 of the architectural structure of FIG. 2.
Figure 5:
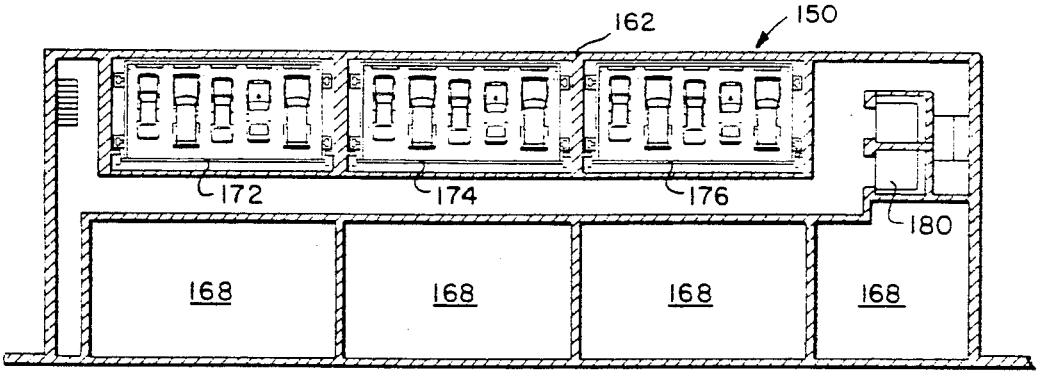
FIG. 5 is a broken away, top plan view at one of levels 6 through 24 of the architectural structure of FIG. 2.

FIGS. 2–7, in accordance with the present invention, show an integrated architectural structure 150 comprising, on a limited site, personal occupancy space generally shown at 152, automotive vehicle parking space generally shown at 154, and access space generally shown at 156 communicating therebetween. This structure is situated on a narrow lot having a party wall at 162 and a street frontage at 164. Personal occupancy space 152 includes groups of units 166, 168 and 170. Units 166 are retail stores fronting the street. Units 168 are apartments situated over access space 156. Units 170 are apartments set back from the street and situated over units 168 and parking space 154. Automotive vehicle parking space 154 is situated against party wall 162 and extends from below ground level up to the level of group of apartments 168. Parking space 154 includes three lifts 172, 174, 176, each with five levels that carry five vehicles each. Access space 156 is situated between retail store units 166 and parking space 154. Access space 156 includes an apartment lobby 178 and personal occupancy elevators 180. Basement and mechanical space 182 is situated below access space 156. FIGS. 4 and 5 show levels 2–5 and 6–10, respectively. The intimate juxtaposition is such that 75 parking spaces and numerous apartments are provided on an extremely narrow interior block site.

THE EMBODIMENT OF FIGS. 8–11

Figure 10:
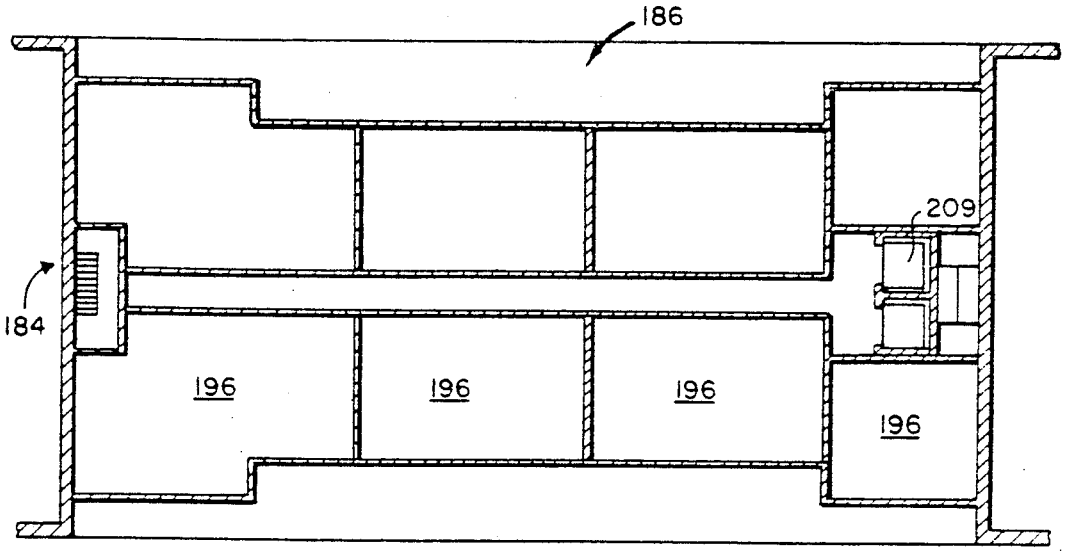
FIG. 10 is a broken away, top plan view at one of levels 2 through 5 of the architectural structure of FIG. 8.
Figure 11:
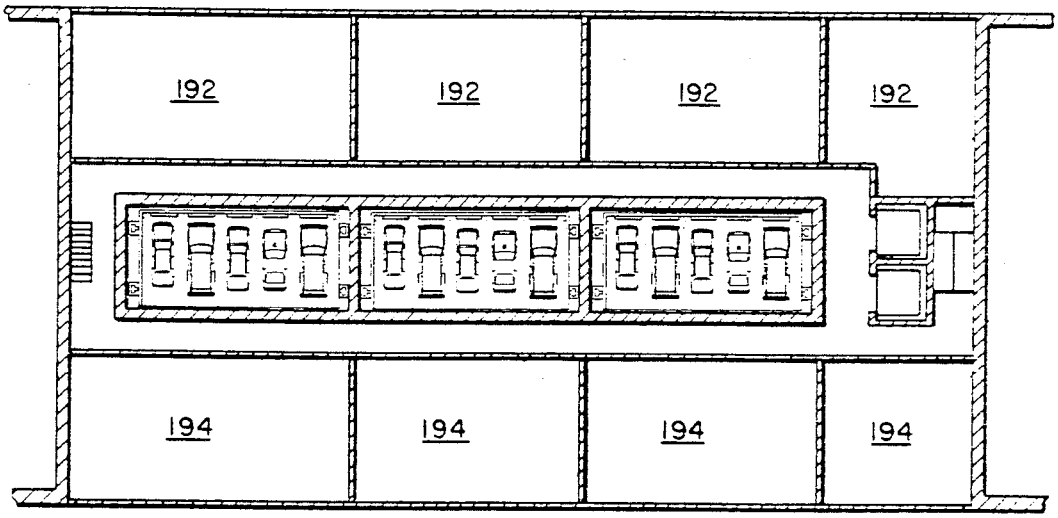
FIG. 11 is a broken away, top plan view at one of levels 6 through 12 of the architectural structure of FIG. 8.
Figure 12:
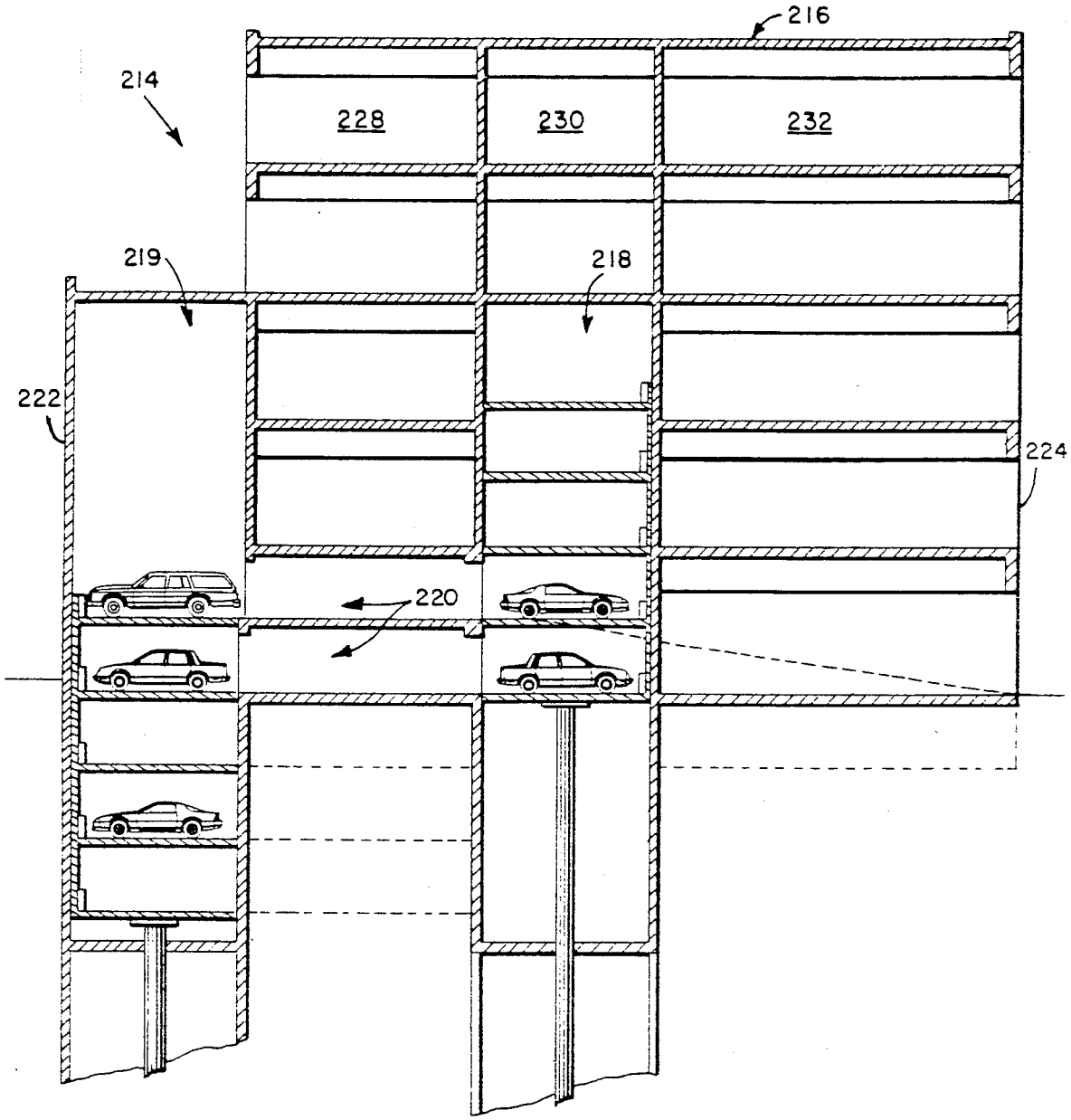
FIG. 12 is a cross section of another architectural structure of the present invention.
Figure 13:
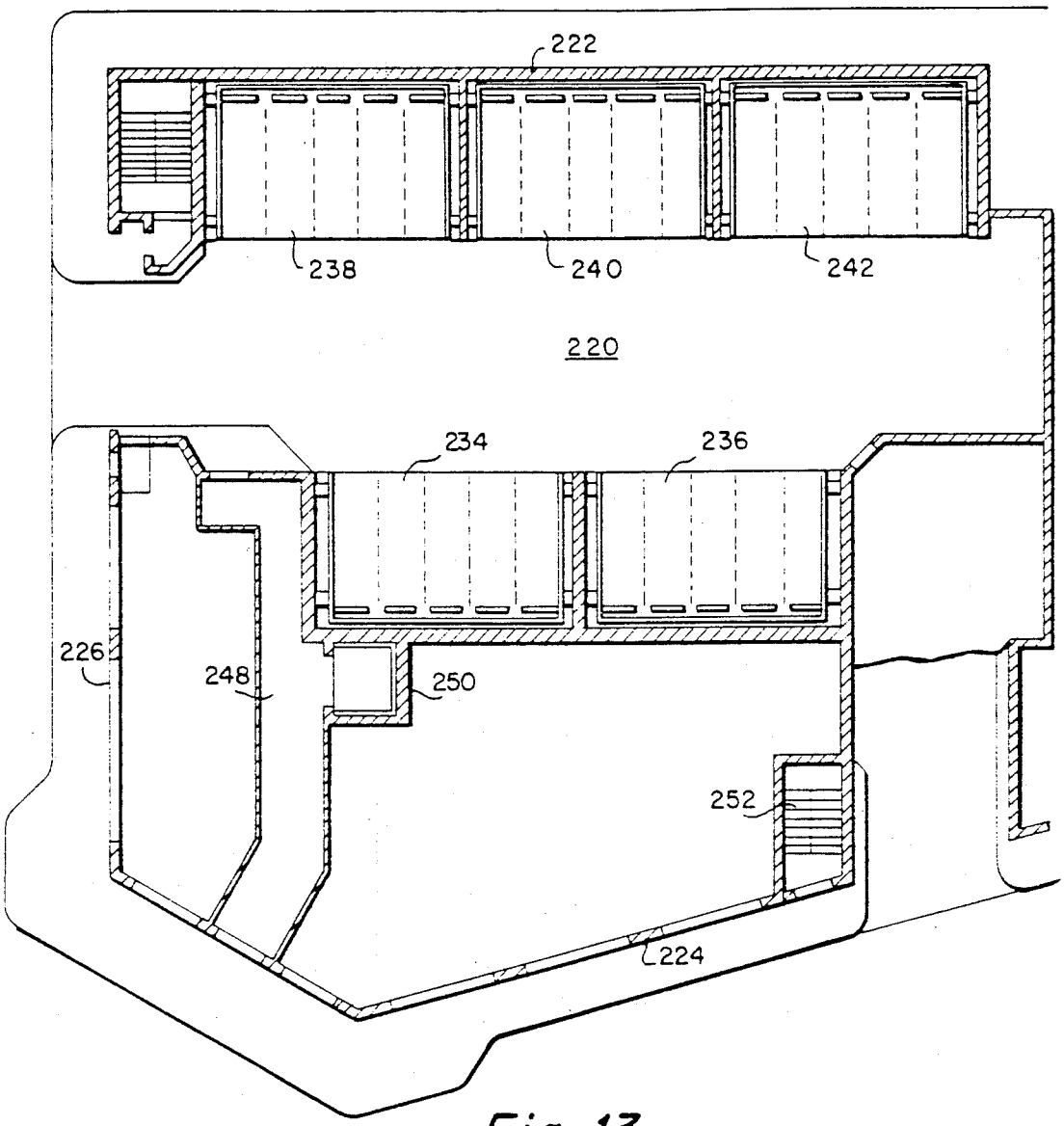
FIG. 13 is a broken away, top plan view of the ground floor of the architectural structure of FIG. 12.
Figure 14:
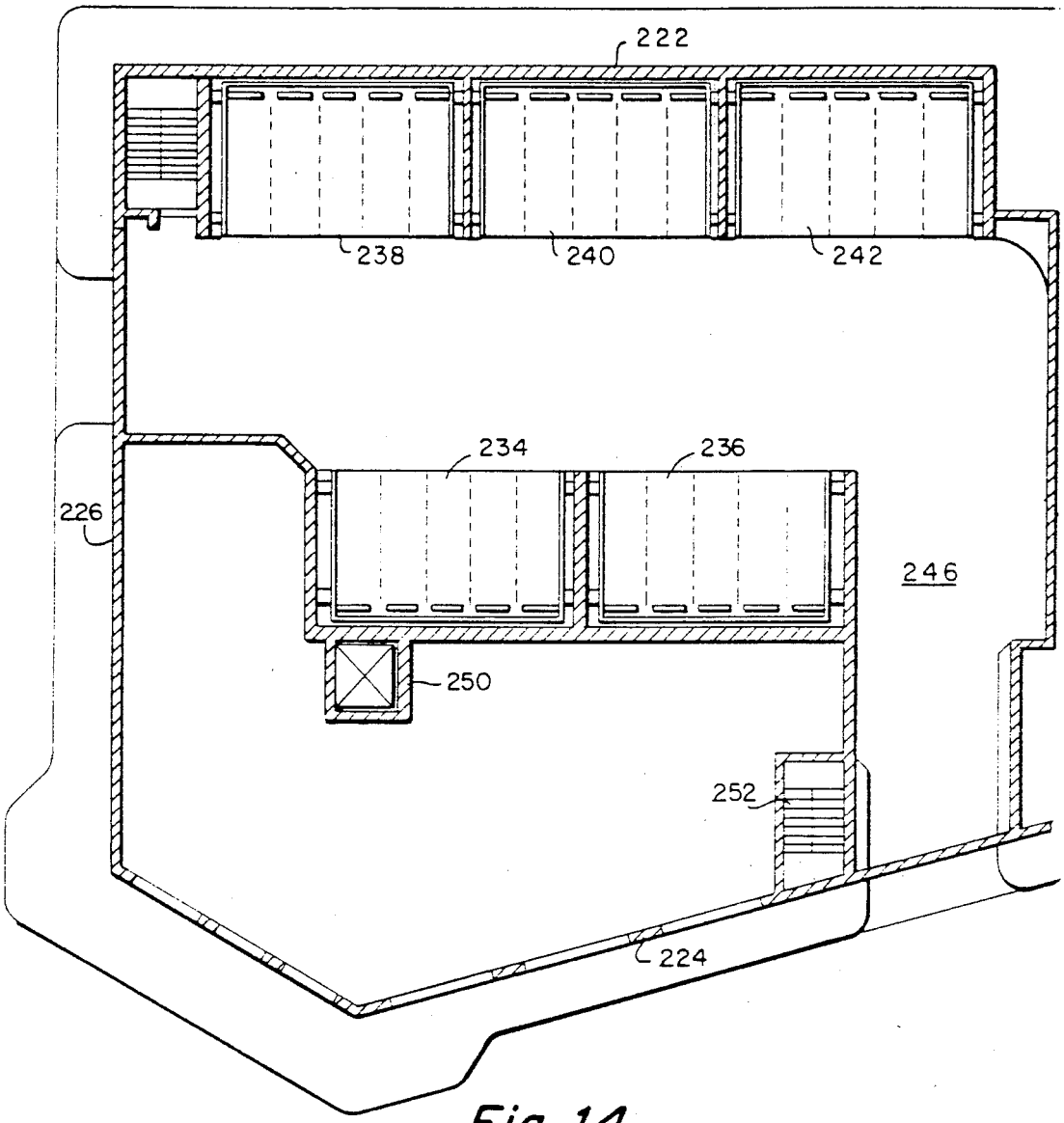
FIG. 14 is a broken away, top plan view of the upper portion of the ground floor of the architectural structure of FIG. 12.

FIGS. 8–11, in accordance with the present invention, show an integrated architectural structure 184 comprising, on a limited site, personal occupancy space generally shown at 186, automotive vehicle parking space generally shown at 188, and access space generally shown at 190 communicating therebetween. This structure is situated on an interior block site with two street exposures. Personal occupancy space 186 includes groups of apartment units 192, 194, 196, and retail units 198 and 200. Units 198, 200 are retail stores fronting the opposite streets. Units 192, 194 are apartments situated over retail space 198 and access space 190. Units 196 are apartments set back from the street and situated over units 192, 194. Automotive vehicle parking space 188 is situated midway between the opposite streets and extends from below ground level up to the level of groups of apartments 192, 194. Parking space 188 includes three lifts 202, 204, 206, each with five levels that carry five cars each. Access space 190 is situated between retail units 198 and parking space 188. Access space 190 includes an apartment lobby 208 and personal occupancy elevators 209. Basement and mechanical space 210, 212 is situated below access space 190 and retail stores 192. FIGS. 10 and 11 show the layouts of levels 2–5 and 6–10, respectively. The intimate juxtaposition is such that 75 parking spaces and numerous apartments are provided with all apartments having an outside street view.

THE EMBODIMENT OF FIGS. 12–16

Figure 15:
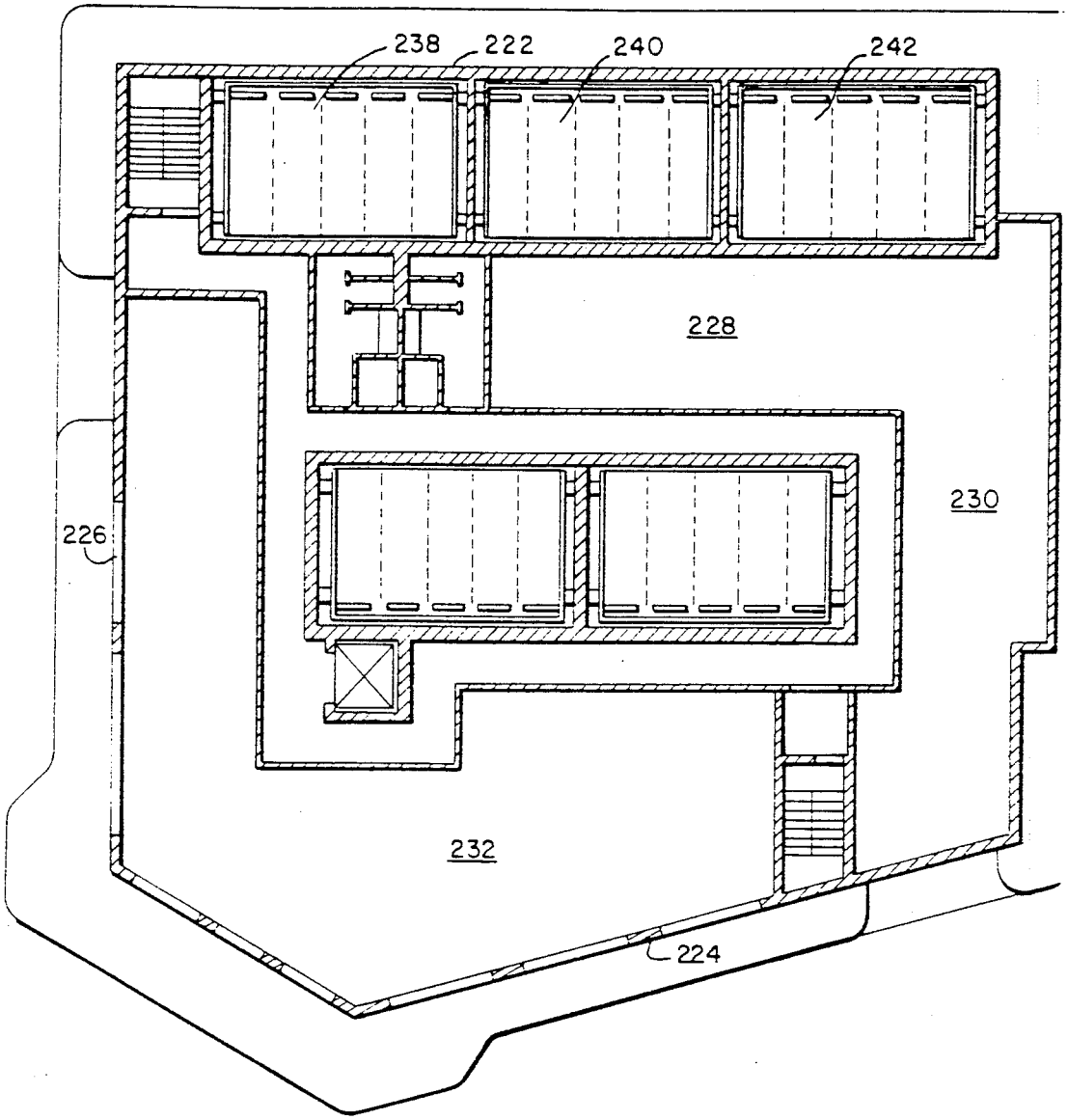
FIG. 15 is a broken away, top plan view of floors two and three of the architectural structure of FIG. 12.
Figure 16:
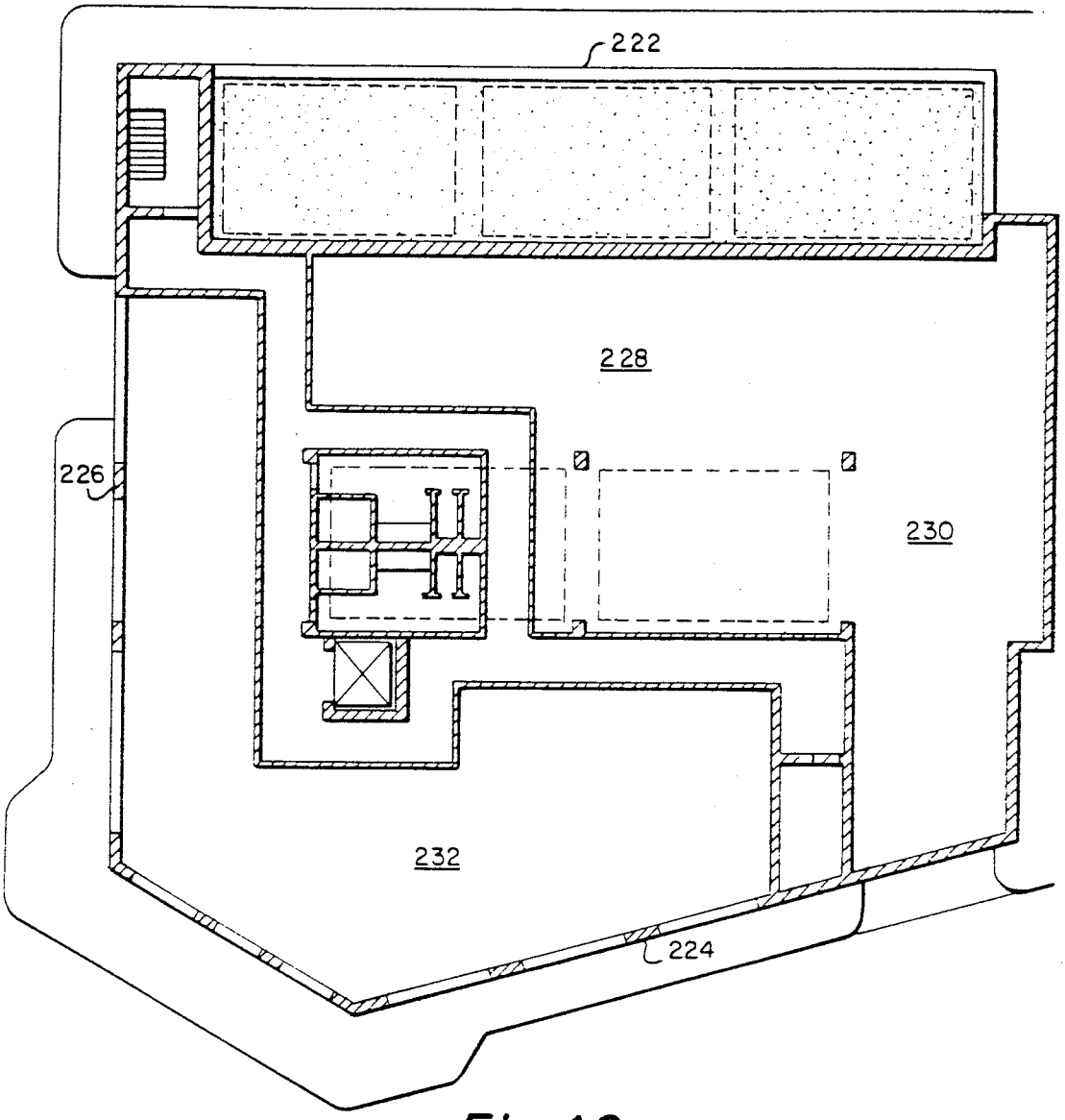
FIG. 16 is a broken away, top plan view of floors four and five of the architectural structure of FIG. 12.

FIGS. 12–16, in accordance with the present invention, show an integrated architectural structure 214 comprising, on a limited site, personal occupancy space generally shown at 216, automotive vehicle parking space generally shown as having a central section 218 and a rearward section 219, and access space generally shown at 220 communicating therebetween. This structure is situated on an irregularly shaped lot having street frontage at 222, 224, 226 (FIG. 13). 228, 230 and 232. Units 216 are commercial and office units fronting the street. Units 230 overly parking space 218. Parking space 219 is at the rear of the lot. Parking space 218 includes two lifts 234 and 236, each with a vertical array of five levels, each having location separation stripes and carrying a horizontal array of four vehicles. Parking space 219 includes three lifts 238, 240, 242, each with five levels, each of which carries an array of four vehicles. Access space 220, which is situated between parking space 218 and parking space 219, has an upper level and a lower level, which communicate by a ramp 246. Lower access space 220 includes a lobby 248, a personal occupancy elevator 250, and a stairwell 252. Upper access space 220 includes a similarly located lobby 248 and a similar access to personal occupancy elevator 250 and stairwell 252. FIGS. 15 and 16 depict the layout of the second and third floors to demonstrate the extraordinarily large number of offices that are available in a low rise architectural structure embodying the present invention.

OPERATION

The system is such that an incoming driver actuates an terminal while seated in his car by punching his code into a key pad or inserting a coded plastic card into a reader slot. The computer system matches the driver's code with an empty location and directs the elevator to move vertically until the empty location is available to the access region. The driver drives the vehicle into the available location, locks his car, and returns to the access area. The driver then actuates an input terminal to notify the computer system that the lift is available for further storage and retrieval. The driver then is free to leave, never having been required to enter the parking space other than at the access level. When retrieving his car, the driver merely reverses the above steps. The driver is in the elevator only when he stores or retrieves his car at access level. The vehicle engine is off at all other times.

What is claimed is:

1. An integrated architectural structure comprising a limited site and an architectural structure comprising:

(a) personal occupancy space;
(b) automotive vehicle parking space;
(c) access space communication therebetween;
(d) said personal occupancy space, said vehicle parking space, and said access space, being intimately juxtaposed;
(e) a plurality of personal occupancy units in said occupancy space;
(f) at least one personal occupancy elevator in said personal occupancy space, communicating between said access space, and said personal occupancy units;
(g) at least one parking elevator located internally of said structure in said automotive vehicle parking space, said parking elevator being movable only vertically and including a vertical array of levels, each level including at least one automobile, vehicle parking location;
(h) motive means for moving said parking elevator to selected vertical positions such that selected levels of said vertical array communicate with said access region at selected times, said motive means including an oil hydraulic lift including an oil reservoir, a cylinder and a piston; and
(i) coded electronic means for controlling the operation of said motive means;
(j) said hydraulic lift cylinder extending below the floor of the basement of said structure, and said piston being partially within said cylinder;
(k) vertically movable doors interposed between said elevator space and said access space;
(l) memory means having coded designations of said parking spaces and coded indicia of whether they are empty or full;
(m) input means at the access area for receiving coded identifications of automotive vehicle drivers;
(n) logic means for generating associations and disassociations of said coded designations and said coded identifications to provide said coded indicia of empty and full;
(o) control means for causing said motive means to move said parking elevator internally of said structure to a selected vertical position when a selected coded designation is specified by a selected coded identification as permitted by a selected coded indicia;
(p) said input means including sensors at locations on said lift to provide indications that said locations are full or empty;
(q) said input means comprising a coded driver actuated key pad;
(r) said sensors being weight responsive.

2. An integrated architectural structure comprising a limited site and an architectural structure comprising:

(a) personal occupancy space;
(b) automotive vehicle parking space;
(c) access space communicating therebetween;
(d) said personal occupancy space, said vehicle parking space, and said access space, being intimately juxtaposed;
(e) a plurality of personal occupancy units in said occupancy space;
(f) at least one personal occupancy elevator in said personal occupancy space, communicating between said access space, and said personal occupancy units;
(g) at least one parking elevator located internally of said structure in said automotive vehicle parking space, said parking elevator being movable only vertically and including a vertical array of levels, each level including at least one automobile vehicle parking location;
(h) motive means for moving said parking elevator to selected vertical positions such that selected levels of said vertical array communicate with said access region at selected times said motive means including an oil hydraulic lift including an oil reservoir, a cylinder and a piston; and
(i) coded electronic means for controlling the operation of said motive means;

(j) said hydraulic lift cylinder extending below the floor of the basement of said structure, and said piston being partially within said cylinder;
(k) vertically movable doors interposed between said elevator space and said access space;
(l) memory means having coded designations of said parking spaces and coded indicia of whether they are empty or full;
(m) input means at the access area for receiving coded identifications of automotive vehicle drivers;
(n) logic means for generating associations and disassociations of said coded designations and said coded identifications to provide said coded indicia of empty and full;
(o) control means for causing said motive means to move said parking elevator internally of said structure to a selected vertical position when a selected coded designation is specified by a selected coded identification as permitted by a selected coded indicia;
(p) said input means including sensors at locations on said lift to provide indications that said locations are full or empty;
(q) said input means comprising a coded driver actuated key pad;
(r) said sensors being photoelectrically responsive.

3. An integrated architectural structure comprising a limited site and an architectural structure comprising:
(a) personal occupancy space;
(b) automotive vehicle parking space;
(c) access space communicating therebetween;
(d) said personal occupancy space, said vehicle parking space, and said access space, being intimately juxtaposed;
(e) a plurality of personal occupancy units in said occupancy space;
(f) at least one personal occupancy elevator in said personal occupancy space, communicating between said access space, and said personal occupancy units;
(g) at least one parking elevator located internally of said structure in said automotive vehicle parking space, said parking elevator being movable only vertically and including a vertical array of levels, each level including at least one automobile vehicle parking location;
(h) motive means for moving said parking elevator to selected vertical positions such that selected levels of said vertical array communicate with said access region at selected times said motive means including an oil hydraulic lift including an oil reservoir, a cylinder and a piston; and
(i) coded electronic means for controlling the operation of said motive means;
(j) said hydraulic lift cylinder extending below the floor of the basement of said structure, and a piston partially within said cylinder;
(k) vertically movable doors interposed between said elevator space and said access space;
(l) memory means having coded designations of said parking spaces and coded indicia of whether they are empty or full;
(m) input means at the access area for receiving coded identifications of automotive vehicle drivers;
(n) logic means for generating associations and disassociations of said coded designations and said coded identifications to provide said coded indicia of empty and full;
(o) control means for causing said motive means to move said parking elevator internally of said structure to a selected vertical position when a selected coded designation is specified by a selected coded identification as permitted by a selected coded indicia;
(p) said input means including sensors at locations on said lift to provide indications that said locations are full or empty;
(q) said input means comprising a coded plastic card;
(r) said sensors being photoelectrically responsive.

4. An integrated architectural structure comprising a limited site and an architectural structure comprising:
(a) personal occupancy space;
(b) automotive vehicle parking space;
(c) access space communicating therebetween;
(d) said personal occupancy space, said vehicle parking space, and said access space, being intimately juxtaposed;
(e) a plurality of personal occupancy units in said occupancy space;
(f) at least one personal occupancy elevator in said personal occupancy space, communicating between said access space, and said personal occupancy units;
(g) at least one parking elevator in said automotive vehicle parking space, said parking elevator being movable only vertically and including a vertical array of levels, each level including a horizontal array of automobile vehicle parking locations;
(h) motive means for moving said parking elevator to selected vertical positions such that selected levels of said vertical array communicate with said access region at selected times, said motive means including an oil hydraulic lift including an oil reservoir, a cylinder and a piston;
(i) coded electronic means for controlling the operations of said motive means;
(j) memory means having coded designations of said parking spaces and coded indicia of whether they are empty or full;
(k) input means at the access area for receiving coded identifications of automotive vehicle drivers;
(l) logic means for generating associations and disassociations of said coded designations and said coded identifications to provide said coded indicia of empty and full;
(m) control means for causing said motive means to move said parking elevator to a selected vertical position when a selected coded designation is specified by a selected coded identification as permitted by a selected coded indicia;
(n) said input means including sensors at locations on said lift to provide indications that said locations are full or empty;
(o) said sensors being photoelectrically responsive.

5. An integrated architectural structure comprising a limited site and an architectural structure comprising:
(a) personal occupancy space;
(b) automotive vehicle parking space;
(c) access space communicating therebetween;
(d) said personal occupancy space, said vehicle parking space, and said access space, being intimately juxtaposed;
(e) a plurality of personal occupancy units in said occupancy space;

(f) at least one personal occupancy elevator in said personal occupancy space, communicating between said access space, and said personal occupancy units;

(g) at least one parking elevator in said automotive vehicle parking space, said parking elevator being movable only vertically and including a vertical array of levels, each level including a horizontal array of automobile vehicle parking locations;

(h) motive means for moving said parking elevator to selected vertical positions such that selected levels of said vertical array communicate with said access region at selected times, said motive means including an oil hydraulic lift including an oil reservoir, a cylinder and a piston;

(i) coded electronic means for controlling the operation of said motive means;

(j) memory means having coded designations of said parking spaces and coded indicia of whether they are empty or full;

(k) input means at the access area for receiving coded identifications of automotive vehicle drivers;

(l) logic means for generating associations and disassociations of said coded designations and said coded identifications to provide said coded indicia of empty and full;

(m) control means for causing said motive means to move said parking elevator to a selected vertical position when a selected coded designation is specified by a selected coded identification as permitted by a selected coded indicia;

(n) said input means including sensors at locations on said lift to provide indications that said locations are full or empty;

(o) said integrated architectural structure having a plurality of street exposures, said personal occupancy space including groups of apartment units and retail units, said retail units fronting certain of said street exposures, said apartment units overlying certain of said retail units, said parking space being interposed between said street exposures.

6. An integrated architectural structure comprising a limited site, and an architectural structure comprising:

(a) personal occupancy space;

(b) automotive vehicle parking space;

(c) access space communicating therebetween ;

(d) said personal occupancy space, said vehicle parking space, and said access space, being intimately juxtaposed;

(e) a plurality of personal occupancy units in said occupancy space;

(f) at least one personal occupancy elevator in said personal occupancy space, communicating between said access space, and said personal occupancy units;

(g) at least one parking elevator in said automotive vehicle parking space, said parking elevator being movable only vertically and including a vertical array of levels, each level including a horizontal array of automobile vehicle parking locations;

(h) motive means for moving said parking elevator to selected vertical positions such that selected levels of said vertical array communicate with said access region at selected times, said motive means including an oil hydraulic lift including an oil reservoir, a cylinder and a piston;

(i) coded electronic means for controlling the operation of said motive means;

(j) memory means having coded designations of said parking spaces and coded indicia of whether they are empty or full;

(k) input means at the access area for receiving coded identifications of automotive vehicle drivers;

(l) logic means for generating associations and disassociations of said coded designations and said coded identifications to provide said coded indicia of empty and full;

(m) control means for causing said motive means to move said parking elevator to a selected vertical position when a selected coded designation is specified by a selected coded identification as permitted by a selected coded indicia;

(n) said input means including sensors at locations on said lift to provide indications that said locations are full or empty;

(o) said integrated architectural structure fronting a street, said personal occupancy space including groups of office and commercial units, certain of commercial units fronting said street, certain of said office units overlying said parking space.

7. An integrated architectural structure comprising a limited site located between a rear party wall and a street frontage, said architectural structure comprising:

(a) automotive vehicle parking space abutting said rear party wall;

(b) personal occupancy space situated both above and in front of said vehicle parking space;

(c) access space communicating with both said vehicle parking space and said personal occupancy space;

(d) said personal occupancy space, said vehicle parking space, and said access space, being intimately juxtaposed;

(e) a plurality of personal occupancy units in said occupancy space, some of said units fronting said street, others of said units located above said access space, and still others of said units located both above said others of said units located above said access space and said vehicle parking space;

(f) at least one personal occupancy elevator in said personal occupancy space, communicating between said access space, and said personal occupancy units;

(g) a plurality of parking elevators in said vehicle parking space, each of said parking elevators being movable only vertically and including a vertical array of levels, each level including a horizontal array of at least one vehicle parking location;

(h) motive means for moving said plurality of parking elevators to selected vertical positions such that selected levels of said vertical array communicate with said access region at selected times, said motive means including an oil hydraulic lift including an oil reservoir, a cylinder and a piston;

(i) a plurality of vertical rails for each of said plurality of parking elevators for guiding said parking elevators while moving vertically in response to movement of said piston;

(j) coded electronic means for controlling the operation of said motive means;

(k) said coded electronic means including memory means having coded designations of said parking spaces and coded indicia of whether they are empty or full;

(l) control means for causing said motive means to move said parking elevators to selected vertical positions when a selected coded designation is specified by a selected coded identification as permitted by a selected coded indicia;

(m) input means at the access area for receiving coded identifications of automotive vehicle drivers:

(n) said input means including sensors at locations on said parking elevators to provide indications that said locations are full or empty, said sensors being photoelectrically responsive.

* * * * *